US011537075B2

(12) United States Patent
Taki

(10) Patent No.: US 11,537,075 B2
(45) Date of Patent: Dec. 27, 2022

(54) IMAGE FORMING SYSTEM, IMAGE FORMING APPARATUS, AND PROGRAM

(71) Applicant: Konica Minolta, Inc., Tokyo (JP)

(72) Inventor: Kenji Taki, Fuchu (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 17/374,845

(22) Filed: Jul. 13, 2021

(65) Prior Publication Data

US 2022/0019165 A1 Jan. 20, 2022

(30) Foreign Application Priority Data

Jul. 17, 2020 (JP) ..... JP2020-122591

(51) Int. Cl.
*G03G 15/00* (2006.01)

(52) U.S. Cl.
CPC ..... *G03G 15/5062* (2013.01); *G03G 15/5029* (2013.01)

(58) Field of Classification Search
CPC ..... G03G 15/5029; G03G 15/5062; G03G 15/6594; G03G 2215/00738; G03G 2215/00742; G03G 2215/00751
See application file for complete search history.

(56) References Cited

U.S. PATENT DOCUMENTS 6,389,241 B1 * 5/2002 Cernusak ..... G03G 15/2003 399/45
10,166,790 B1 * 1/2019 Wilsher ..... B41J 11/0095
2014/0270822 A1 * 9/2014 Yamashina ..... G03G 15/5029 399/45
2015/0293487 A1 * 10/2015 Takenaga ..... G03G 15/5062 356/73
2016/0031250 A1 * 2/2016 Yokozawa ..... G03G 15/5029 347/19
2016/0187826 A1 * 6/2016 Mamura ..... G03G 15/5062 399/45
2017/0123359 A1 * 5/2017 Monde ..... G03G 15/5062
2019/0302670 A1 * 10/2019 Kitamura ..... G03G 15/5029
2021/0223733 A1 * 7/2021 Kobayashi ..... G03G 15/6591

FOREIGN PATENT DOCUMENTS

JP 2019-200397 A 11/2019

* cited by examiner

*Primary Examiner* — Carla J Therrien

(74) *Attorney, Agent, or Firm* — Squire Patton Boggs (US) LLP

(57) ABSTRACT

There is provided an image forming system including an image forming apparatus including a hardware processor that forms an image on a recording material, and the image forming system includes: a first detector that detects recording material information on the recording material; a recording material storage that stores the recording material; and a controller that specifies one type of the recording material from type candidates of the recording material based on an execution result of test printing, by executing the test printing under an image forming condition that is set in accordance with one or more type candidates of the recording material, the one or more type candidates being extracted based on the recording material information detected by the first detector.

21 Claims, 10 Drawing Sheets

FIG. 7

| | PAPER QUALITY | SHEET FEEDING AIR VOLUME, SHEET CONVEYANCE SPEED, ... | | | |
|---|---|---|---|---|---|
| | BASIS WEIGHT (g) | FIXING TEMPERATURE TARGET VALUE (°C) | FIXING TEMPERATURE LIMIT VALUE (°C) | SECONDARY TRANSFER CURRENT TARGET VALUE (mA) | SECONDARY TRANSFER CURRENT LIMIT VALUE (mA) |
| | 50 TO 99 | 155 | 150 TO 160 | A1 | b1 TO c1 |
| | 100 TO 149 | 160 | 155 TO 165 | A2 | b2 TO c2 |
| a | 150 TO 199 | 165 | 160 TO 170 | A3 | b3 TO c3 |
| b | 200 TO 249 | 170 | 160 TO 175 | A4 | b4 TO c4 |
| c | 250 TO 299 | 175 | 170 TO 185 | A5 | b5 TO c5 |
| | 300 TO 349 | 180 | 175 TO 195 | A6 | b6 TO c6 |
| | 350 TO 399 | 185 | 175 TO 205 | A7 | b7 TO c7 |

FIG. 8

| SHEET TYPE CANDIDATE | PAPER QUALITY | BASIS WEIGHT (g) | SIZE |
|---|---|---|---|
| A | PLAIN PAPER | 50 TO 99 | A3 |
| B | COATED PAPER | 50 TO 99 | A3 |
| C | COATED PAPER | 100 TO 149 | A3 |

(1) IMAGE SENSOR

| PAPER QUALITY | IMAGE DENSITY |
|---|---|
| PLAIN PAPER | 8 |
| COATED PAPER | 9 TO 10 |

(2) SHEET TIMING SENSOR

| BASIS WEIGHT (g) | SHEET ARRIVAL TIME (ms) |
|---|---|
| 50 TO 99 | 150 TO 154 |
| 100 TO 149 | 155 TO 159 |
| 150 TO 199 | 160 TO 164 |
| ⋮ | ⋮ |

(3) SECONDARY TRANSFER CURRENT SENSOR

| PAPER THICKNESS (μm) | SECONDARY TRANSFER CURRENT (μA) |
|---|---|
| 100 OR LESS | 150 OR LESS |
| 101 TO 250 | 151 TO 170 |
| 211 TO 500 | 171 TO 190 |
| 511 OR MORE | 191 OR MORE |

(4) TEST IMAGE

FIG. 10

| PREDETERMINED CONDITIONS | PURPOSE (INHIBITING TROUBLE) |
|---|---|
| SHEET FEEDING AIR VOLUME | INHIBITING JAMMING |
| TRANSFER CONDITION | INHIBITING TRANSFER WINDING |
| FIXING CONDITION | INHIBITING TONER STAINS |
| TEST IMAGE | INHIBITING FIXING WINDING |

FIG. 11

| SHEET TYPE CANDIDATE | FIXING TEMPERATURE ALLOWABLE RANGE (°C) | SHEET FEEDING AIR VOLUME ALLOWABLE RANGE (%) | MAXIMUM DENSITY (IMAGE QUALITY CHARACTERISTIC VALUE) |
|---|---|---|---|
| D | 160 TO 185 | 30 TO 40 | 7 TO 8 |
| E | 170 TO 180 | 20 TO 50 | 7 TO 8 |
| F | 170 TO 175 | 35 TO 60 | 7 TO 8 |

IMAGE FORMING SYSTEM, IMAGE FORMING APPARATUS, AND PROGRAM

The entire disclosure of Japanese patent Application No. 2020-122591, filed on Jul. 17, 2020, is incorporated herein by reference in its entirety.

BACKGROUND

Technological Field

The present invention relates to an image forming system, an image forming apparatus, and a program.

Description of the Related Art

It has been necessary to change conditions for printing (called "printing conditions") in accordance with a sheet type, and jamming and image defects may have occurred when incorrect printing conditions are set in an image forming apparatus. In the printing market these days, various types of sheets are used, and it is becoming increasingly difficult for users to grasp types of sheets that have been set in the image forming apparatus. Therefore, image forming systems with media sensors are now available, in which the media sensor that can measure and detect characteristics of a sheet automatically detects a sheet type of a sheet used in the image forming apparatus.

For example, JP No. 2019-200397 A discloses a technique for predicting a sheet type on the basis of a sheet type automatically detected by a media sensor, and determining image forming conditions on the basis of the expected type to form an image on a sheet.

However, sheet characteristics detected with a detection result of the media sensor do not always completely match sheet characteristics of a sheet type registered in advance. There may be a plurality of sheet types having sheet characteristics close to the detected sheet characteristics. The technique disclosed in JP 2019-200397 A further predicts a sheet type by also using a past history to specify one sheet type, but it does not always completely match the sheet characteristics detected with the detection result of the media sensor.

That is, from the limited characteristics that can actually be detected by the media sensor, it may not be possible to narrow down to one sheet type, and a plurality of sheet types may be candidates in some cases. If it is not possible to narrow down the sheet type as in the above, it becomes difficult to determine optimum image forming conditions for the actually loaded sheet.

SUMMARY

The present invention has been made in view of such circumstances, and an object is to enable accurate specification of a sheet type even when a media sensor is not able to narrow down the sheet type.

To achieve the abovementioned object, according to an aspect of the present invention, there is provided an image forming system comprising an image forming apparatus including a hardware processor that forms an image on a recording material, and the image forming system reflecting one aspect of the present invention comprises: a first detector that detects recording material information on the recording material; a recording material storage that stores the recording material; and a controller that specifies one type of the recording material from type candidates of the recording material based on an execution result of test printing, by executing the test printing under an image forming condition that is set in accordance with one or more type candidates of the recording material, the one or more type candidates being extracted based on the recording material information detected by the first detector.

BRIEF DESCRIPTION OF THE DRAWINGS

The problems, configurations, effects, advantages, and features provided by one or more embodiments of the invention will become more fully understood from the detailed description given hereinbelow and the appended drawings which are given by way of illustration only, and thus are not intended as a definition of the limits of the present invention:

FIG. 7 is a view showing a configuration example of an allowable control condition table according to an embodiment of the present invention;

FIG. 8 is a view showing an example of paper quality, a basis weight, and a size for each sheet type candidate according to an embodiment of the present invention;

FIG. 10 is a view showing a correspondence between a predetermined condition and a purpose in test printing according to an embodiment of the present invention; and FIG. 11 is a view showing a relationship between a sheet type candidate, and allowable ranges of printing conditions and a maximum density (image quality characteristic value), according to a modification of an embodiment of the present invention.

DETAILED DESCRIPTION OF EMBODIMENTS

Figure 1:
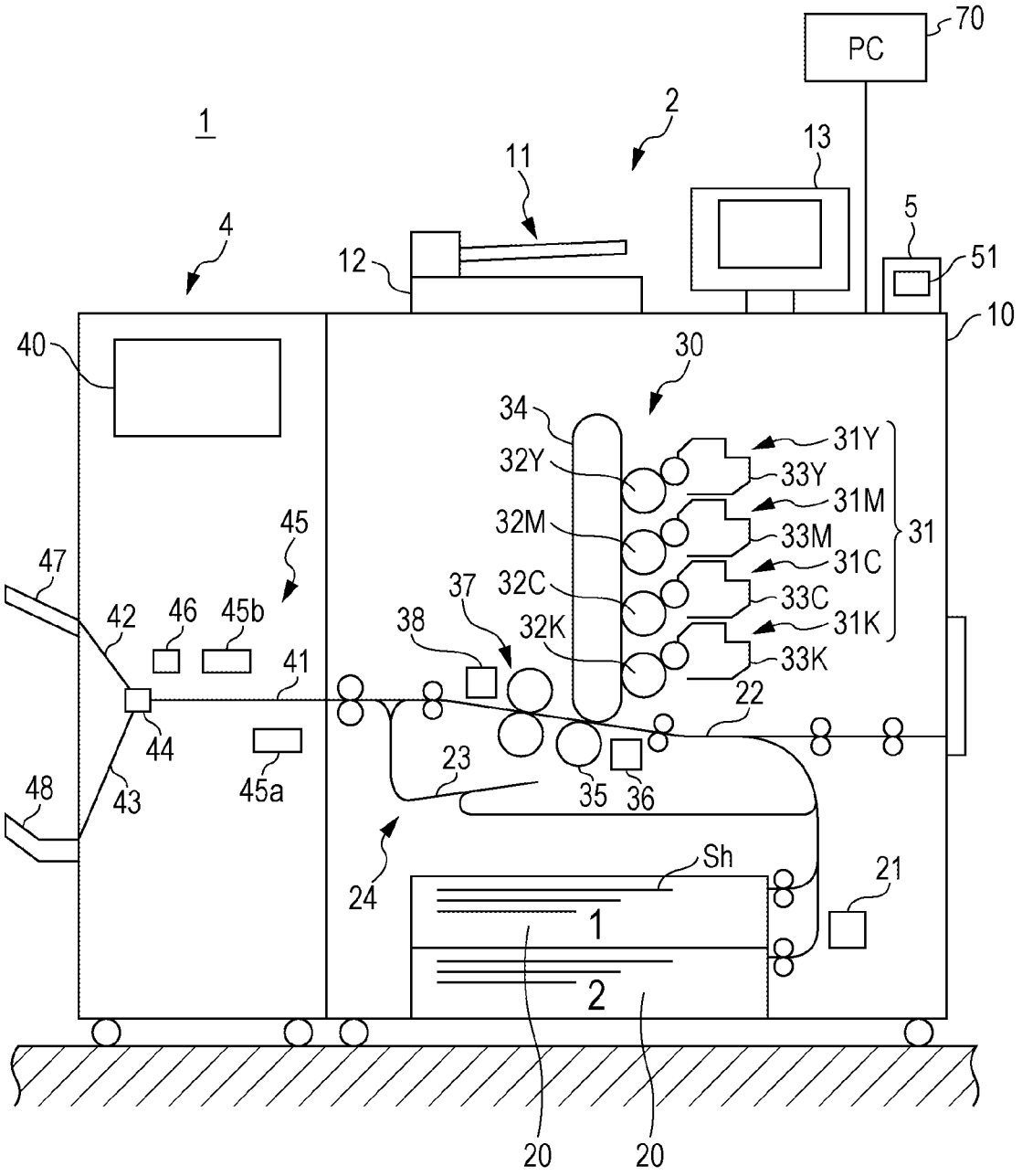
FIG. 1 is a schematic configuration view of an image forming system according to an embodiment of the present invention.

Hereinafter, one or more embodiments of the present invention will be described with reference to the drawings. However, the scope of the invention is not limited to the disclosed embodiments. In this specification and the drawings, parts having substantially the same function or configuration are denoted by the same reference numerals, and redundant explanations are omitted.

One Embodiment

Configuration of Image Forming System

First, a configuration example of an image forming system according to an embodiment of the present invention will be described with reference to FIG. 1.

FIG. 1 is a schematic configuration view of an image forming system 1 according to an embodiment of the present invention. Note that FIG. 1 shows constituents considered necessary for the description of the present invention or related constituents, and the image forming system of the present invention is not limited to the example shown in FIG. 1.

The image forming system 1 includes an image forming apparatus 2, an image inspection device 4, and a media sensor 5. The media sensor 5 is an apparatus used by a user to detect sheet information on a sheet Sh and select a sheet feeding tray 20 to be loaded with the sheet Sh, before the sheet Sh is loaded in the sheet feeding tray 20 included in the image forming apparatus 2. Therefore, the media sensor 5 is installed outside the image forming apparatus 2. The media sensor 5 can measure at least one or more pieces of sheet information among a thickness, smoothness, rigidity, or a basis weight of the sheet Sh. This media sensor 5 is used as an example of a sheet information detection device that detects sheet information on the sheet Sh.

First, an internal configuration example of the image forming apparatus 2 will be described.

The image forming apparatus 2 is an example of an image forming apparatus that forms an image on a sheet by an electrophotographic system that forms an image using static electricity. For example, the image forming apparatus 2 forms a color image on the sheet Sh in a tandem manner in which toner images of four colors of yellow (Y), magenta (M), cyan (C), and black (K) are superimposed with each other. In the image forming apparatus 2, a plurality of sensors are installed. To the image forming apparatus 2 capable of measuring a behavior of the sheet Sh during conveyance, an electric resistance value, specific heat, and the like, an information processing apparatus such as a personal computer (PC) 70 that is operated by a user is connected via a local area network (LAN). Then, a job is inputted from the PC 70 to the image forming apparatus 2 via the LAN. The image forming apparatus 2 performs various processes such as an image forming process according to the inputted job.

This image forming apparatus 2 includes an image input part 11 having an auto document feeder (ADF) 12 and an operation display 13. Further, the image forming apparatus 2 includes a printer 10 having the sheet feeding tray 20 and an image former 30.

The image input part 11 optically reads an image from a document on a document table of the ADF 12, and performs A/D conversion on the read image to generate image data. The image input part 11 can also read an image from a document on a platen glass.

The operation display 13 includes a display formed by a liquid crystal panel and the like, and an operation part formed by a touch sensor and the like. The display and the operation part are integrally formed as a touch panel, for example. The operation display 13 generates an operation signal representing details of an operation inputted to the operation part from the user, and supplies the operation signal to an entire controller 60 (see FIG. 3 described later). Further, the operation display 13 displays the details of the operation by the user, setting information, and the like on the display, on the basis of a display signal supplied from the entire controller 60. Note that the operation part may be formed by a mouse, a tablet, or the like, and may also be formed separately from the display.

The sheet feeding tray 20 is a container that stores sheets Sh to be subjected to image formation (printing) by the image former 30. The sheet Sh is an example of a recording material. The sheet feeding tray 20 is used as an example of a recording material storage that can store the sheets Sh having different sheet types, basis weights, and the like. The image forming apparatus 2 can also form an image on a resin sheet, which is an example of a recording material. As shown in FIG. 1, sheet feeding tray numbers "1" and "2" are assigned to enable identification of each sheet feeding tray 20. Therefore, in the following description, the sheet feeding tray 20 may be referred to as "Sheet feeding tray 1" or "Sheet feeding tray 2" in accordance with the sheet feeding tray number. When Sheet feeding trays 1 and 2 are not distinguished, they may be referred to simply as a "sheet feeding tray".

Although an example is described in which two sheet feeding trays 20 are provided the present embodiment, the number of the sheet feeding trays 20 may be one, or may be three or more. In addition, a large-capacity sheet feeding device may be connected to the image forming apparatus 2, and the sheet Sh may be fed from a sheet feeding tray provided in the large-capacity sheet feeding device to the image forming apparatus 2. In this case, a uniquely identifiable sheet feeding tray number is also assigned to the sheet feeding tray provided in the large-capacity sheet feeding device.

The image forming apparatus 2 is provided with a conveyance path 22 that conveys the sheet Sh fed from the sheet feeding tray 20 to the image inspection device 4. The conveyance path 22 is provided with a plurality of conveyance rollers for conveyance of the sheet Sh. Therefore, the conveyance path 22 is used as an example of a conveyor that conveys the sheet Sh. The conveyance path 22 is provided with a timing sensor 21 that detects an arrival timing of the sheet Sh. The timing sensor 21 measures, for example, time (referred to as a "sheet arrival time") after the sheet Sh is sent out from the sheet feeding tray 20 until a tip end of the sheet Sh reaches a position where the timing sensor 21 can detect the sheet Sh. The sheet arrival time varies depending on a basis weight of the sheet Sh.

On downstream of a fixer 37, the conveyance path 22 extends and is connected to a conveyance path 41 of the image inspection device 4. Further, the conveyance path 22 branches on downstream of the fixer 37. To one end of the branched conveyance path 22, a reverse conveyance path 23 that joins the conveyance path 22 on upstream of the printer 10 is connected. The reverse conveyance path 23 is provided with an inverter 24 to reverse the sheet Sh. The sheet Sh reversed by the inverter 24 is returned to an upstream side of the conveyance path 22 through the reverse conveyance path 23. In addition, the sheet Sh reversed by switching the path may be returned to the conveyance path 22 on downstream of the fixer 37 and then conveyed to the image inspection device 4.

The image former 30 forms an image on the sheet Sh. Therefore, the image former 30 includes four image forming units 31Y, 31M, 31C, and 31K to form toner images of respective colors of Y, M, C, and K. The image forming units 31Y, 31M, 31C and 31K are used as an example of an image former that primarily transfers an image to an intermediate transfer belt 34. When the image forming units 31Y, 31M, 31C and 31K are not distinguished, they are collectively referred to as an image forming unit 31. The image forming units 31Y, 31M, 31C, and 31K are provided with a charger and an exposure (both not shown), photoreceptor drums 32Y, 32M, 32C, and 32K as image carriers, and developers 33Y, 33M, 33C, and 33K, respectively.

The developers 33Y, 33M, 33C, and 33K form an electrostatic latent image on a periphery of each photoreceptor drum by irradiating each surface (outer peripheral part) of the photoreceptor drums 32Y, 32M, 32C, and 32K with light according to the image. Then, the developers 33Y, 33M, 33C, and 33K form toner images on the photoreceptor drums 32Y, 32M, 32C, and 32K by causing the toner to adhere to the electrostatic latent images.

Further, the image former 30 includes the intermediate transfer belt 34, a secondary transferor 35, a secondary transfer current sensor 36, the fixer 37, and a fixing temperature sensor 38. The intermediate transfer belt 34 is a belt on which images formed on the photoreceptor drums 32Y, 32M, 32C, and 32K are primarily transferred. The secondary transferor 35 is a roller that secondarily transfers the toner images of the individual colors that have been primarily transferred onto the intermediate transfer belt 34, onto the sheet Sh that has been conveyed through the conveyance path 22.

The fixer 37 is disposed downstream of the secondary transferor 35 in a sheet conveyance direction, and applies a fixing process on the sheet Sh formed with the color toner image supplied from the image former 30. The fixer 37 fixes the image transferred by the image former 30 on a front surface side of the sheet Sh, by heating and pressurizing the conveyed sheet Sh. The sheet Sh on which the image is fixed by the fixer 37 is conveyed to the image inspection device 4 by the conveyance path 22. Alternatively, the sheet Sh on which the image is fixed is returned to the conveyance path 22 on upstream of the printer 10 after front and back sides are reversed by the inverter 24 through the reverse conveyance path 23. The printer 10 forms an image on a back surface of the sheet Sh with the front and back reversed. Thereafter, the sheet Sh subjected to the image fixing process by the fixer 37 is conveyed to the image inspection device 4.

The secondary transfer current sensor 36 measures a secondary transfer current energized by the secondary transferor 35 when a toner image is transferred onto the sheet Sh. The secondary transfer current varies depending on a thickness of the sheet Sh.

The fixing temperature sensor 38 measures a fixing temperature when the fixer 37 fixes a toner image on the sheet Sh. The fixing temperature varies depending on a difference in a basis weight of the sheet Sh.

The secondary transfer current sensor 36 and the fixing temperature sensor 38 are used as an example of a physical characteristic value sensor that measures a physical characteristic value as information on the sheet Sh. The physical characteristic value sensor may include a sensor that measures other physical characteristic values (for example, a sensor that measures a temperature, a humidity, and the like in the image forming apparatus 2).

Next, a configuration example of the image inspection device 4 will be described.

The image inspection device 4 is installed in a subsequent stage of the image forming apparatus 2, and performs a predetermined inspection on the sheet Sh conveyed from the image forming apparatus 2. Examples of the predetermined inspection performed by the image inspection device 4 include, for example, an inspection of quality of an image formed (printed) on the sheet Sh, and an inspection as to whether the image is formed at a correct position. The processing on the image formed on the sheet Sh, that is, the inspection of the image performed by the image inspection device 4 is mainly performed by an image processing device 40 attached to the image inspection device 4.

The image inspection device 4 has conveyance paths 41, 42, and 43 to convey the sheet Sh conveyed from the image forming apparatus 2, a switcher 44, readers 45*a* and 45*b*, a colorimeter 46, and sheet discharging trays 47 and 48 to which the sheet Sh conveyed on the conveyance path 41 are discharged.

The readers 45*a* and 45*b* each are examples of image input devices such as image sensors. The readers 45*a* and 45*b* measure a density of a test image and an actual image fixed on the sheet Sh. The density varies depending on a type of the sheet Sh. For example, the readers 45*a* and 45*b* project light onto a surface of the sheet Sh, and captures reflected light from the sheet Sh as image data. Capturing of the image data of the sheet Sh by the readers 45*a* and 45*b* in this way is called "reading". The reader 45*a* reads the sheet Sh conveyed through the conveyance path 41 from below the conveyance path 41, while the reader 45*b* reads the sheet Sh conveyed through the conveyance path 41 from above the conveyance path 41. In the following description, since the readers 45*a* and 45*b* are not distinguished, they are collectively referred to as a "reader 45". Then, the reader 45 outputs the captured image data to the image processing device 40.

The colorimeter 46 is an example of a color density measuring device that reads an image formed on an upper surface of the sheet Sh conveyed through the conveyance path 41, and that measures a color density (reflection density) of the image on the basis of image information obtained by the reading. The colorimeter 46 is, for example, a colorimeter capable of measuring intensity (a spectrum) of reflected light for each wavelength of light, and outputs the measured color density (reflection density), L*a*b* value, and the like.

The image inspection device 4 includes the conveyance paths 42 and 43 connected to the conveyance path 41.

The conveyance path 42 is a path that branches from a middle of the conveyance path 41, and discharges the sheet Sh inspected by the image processing device 40 to the sheet discharging tray 47 (an example of a sheet discharger). To the sheet discharging tray 47, the sheet Sh (also referred to as a "normal sheet") whose image is determined to be normal by the image processing device 40 is discharged.

The conveyance path 43 is also a path that branches from a middle of the conveyance path 41, and discharges the sheet Sh inspected by the image processing device 40 to the sheet discharging tray 48 (an example of a sheet discharger). To the sheet discharging tray 48, the sheet Sh (also referred to as an "abnormal sheet") whose image is determined to be abnormal by the image processing device 40 is discharged.

The switcher 44 switches a conveyance direction of the sheet Sh such that the sheet Sh is conveyed to either the conveyance path 42 or 43. When the image inspection device 4 has one sheet discharging tray 47 alone, the normal sheet and the abnormal sheet are mixed and discharged. In this case, the normal sheet and the abnormal sheet are discharged with a slight shift in a direction orthogonal to a direction of discharging.

The sheet Sh conveyed to the image inspection device 4 is printed matter having an image formed on both sides or one side. In the image inspection device 4, the image forming apparatus 2 reads an image formed on both sides or one side of the sheet Sh, and the image processing device 40 performs a predetermined inspection.

In the present embodiment, the media sensor 5 installed outside the image forming apparatus 2 has a first detector 51 that detects sheet information on the sheet Sh. Whereas, sensors and devices other than the media sensor 5 configured in the image forming system 1 are collectively referred to as a "second detector". The second detector is installed inside the image forming apparatus 2 or the image inspection device 4. As the second detector, for example, there is used at least one of the timing sensor 21, the secondary transfer current sensor 36, the fixing temperature sensor 38, or the readers 45*a* and 45*b*. The second detector detects information regarding the sheet Sh in a process in which an image is formed on the sheet Sh supplied from the sheet feeding tray under a predetermined printing condition (an example of an image forming condition) and the sheet Sh is discharged.

In the present embodiment, an example in which the image processing device 40 inspects both sides of the sheet Sh is given, since the image forming apparatus 2 can form an image on both sides of the sheet Sh. However, the image processing device 40 may inspect one side alone of the sheet Sh conveyed from the image forming apparatus capable of forming an image on one side alone of the sheet Sh.

Further, in a subsequent stage of the image forming apparatus 2, a post-processing device that performs post-processing on the sheet Sh formed with an image may be provided instead of the image inspection device 4. Alternatively, the image inspection device 4 and the post-processing device may be provided in a subsequent stage of the image forming apparatus 2. Then, the entire controller 60 can determine information regarding the sheet Sh detected by the second detector included in the inspection device or the post-processing device. In this way, the entire controller 60 can accurately specify one sheet type (type of the sheet Sh) from a plurality of sheet type candidates, on the basis of a result obtained by using, as the second detector, the sensor provided to at least one of the image inspection device 4 or the post-processing device. After that, the entire controller 60 executes actual printing for a job inputted by the user, in accordance with printing conditions corresponding to the specified type of the sheet Sh.

Configuration Example of Control Board of Image Forming Apparatus

Next, an outline of a control board 15 provided in the image forming apparatus 2 will be described with reference to FIG. 2.

Figure 2:
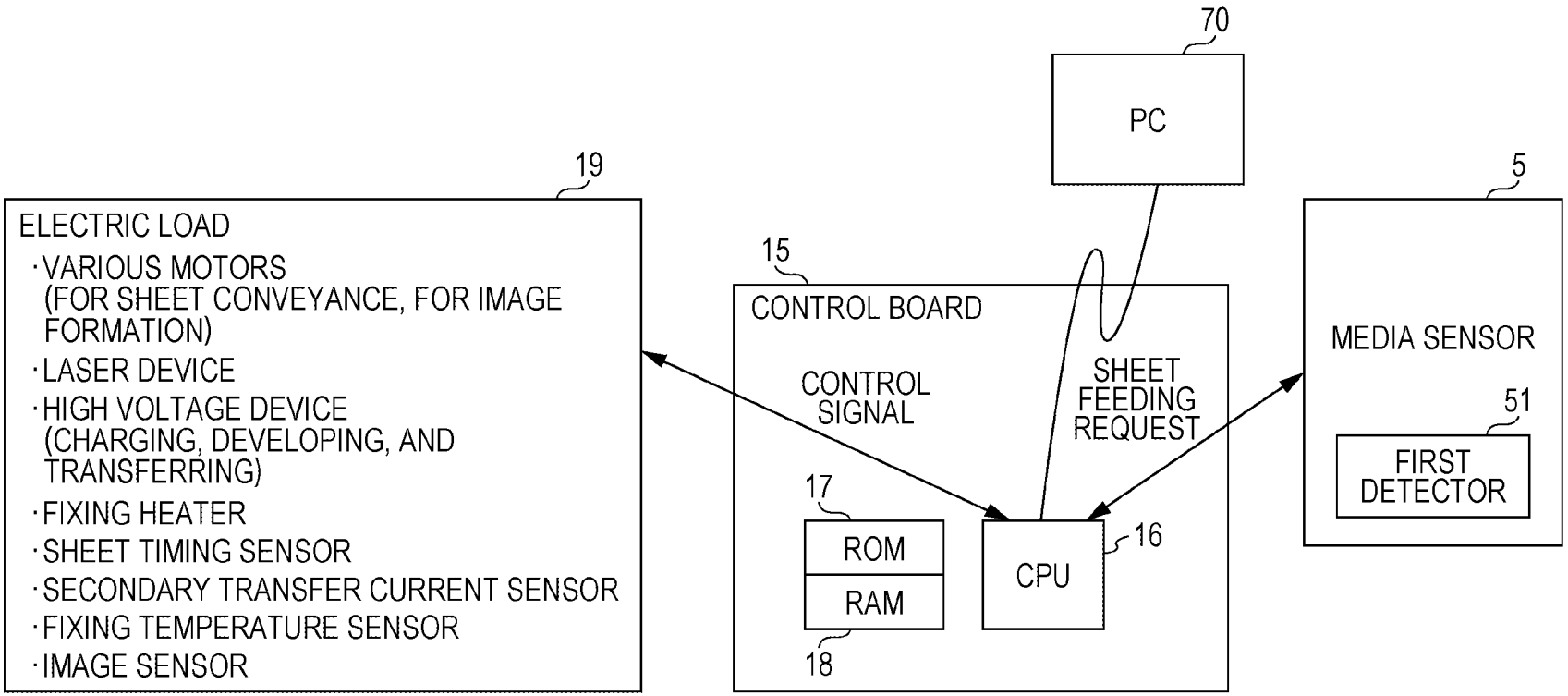
FIG. 2 is a control block diagram showing a hardware configuration example of a control board according to an embodiment of the present invention.

FIG. 2 is a control block diagram showing a hardware configuration example of the control board 15.

The control board 15 provided in the image forming apparatus 2 includes a central processing unit (CPU) 16, a read only memory (ROM) 17, and a random access memory (RAM) 18. The CPU 16, the ROM 17, and the RAM 18 each are connected to a bus (not shown). The control board 15 controls an electric load 19 of the image forming apparatus 2 and the image inspection device 4, controls the media sensor 5, and communicates with the PC 70. The PC 70 transmits a sheet feeding request for feeding the sheet Sh, to the control board 15.

The CPU 16 reads, from the ROM 17, a program code of a control program that realizes each function according to the present embodiment, and loads the program code into the RAM 18 to execute various controls according to the present embodiment. Instead of the CPU 16, a micro processing unit (MPU) may be used.

In addition to the control program read by the CPU 16, the ROM 17 stores a control condition table for sheet type candidates, which will be described later. In addition to an operating system (OS) and various parameters, the ROM 17 records a program for operating the control board 15. The ROM 17 is used as an example of a computer-readable, non-transitory storage medium that stores a program executed by the control board 15. Meanwhile, a non-volatile storage may be used together with the ROM 17, and the CPU 16 may read and execute a program stored in the non-volatile storage. Further, the non-volatile storage may record a plurality of sheet type candidates detected by the media sensor 5, and a sheet type specified with a detection result of the second detector. As the non-volatile storage, for example, a hard disk drive (HDD), a solid state drive (SSD), a non-volatile memory, or the like is used.

The RAM 18 is used to temporarily save data for executing the control program. To the RAM 18, variables and parameters generated during arithmetic processing of the CPU 16 are temporarily written, and these variables and parameters are appropriately read by the CPU 16.

As described above, the media sensor 5 includes the first detector 51 that detects sheet information on the sheet Sh. The first detector 51 outputs the sheet information detected from the sheet Sh to the control board 15, and the sheet information is temporarily saved in the RAM 18.

The electric load 19 includes a collection of loads for printing of an image onto the sheet Sh shown in FIG. 1, and a sensor for detection of sheet characteristics. Examples of the load include various motors used for sheet conveyance, a laser device used for image formation, and the like. Examples of the load also include a high voltage device that applies a high voltage to the image former 30 in charging, developing, and transferring. Further, examples of the load include a fixing heater that heats the fixer 37 to a predetermined fixing temperature. Moreover, examples of the sensor include the timing sensor 21, the secondary transfer current sensor 36, the fixing temperature sensor 38, and the image sensor (the readers 45*a* and 45*b* of the image inspection device 4).

Example of Internal Processing of Image Forming Apparatus

Figure 3:
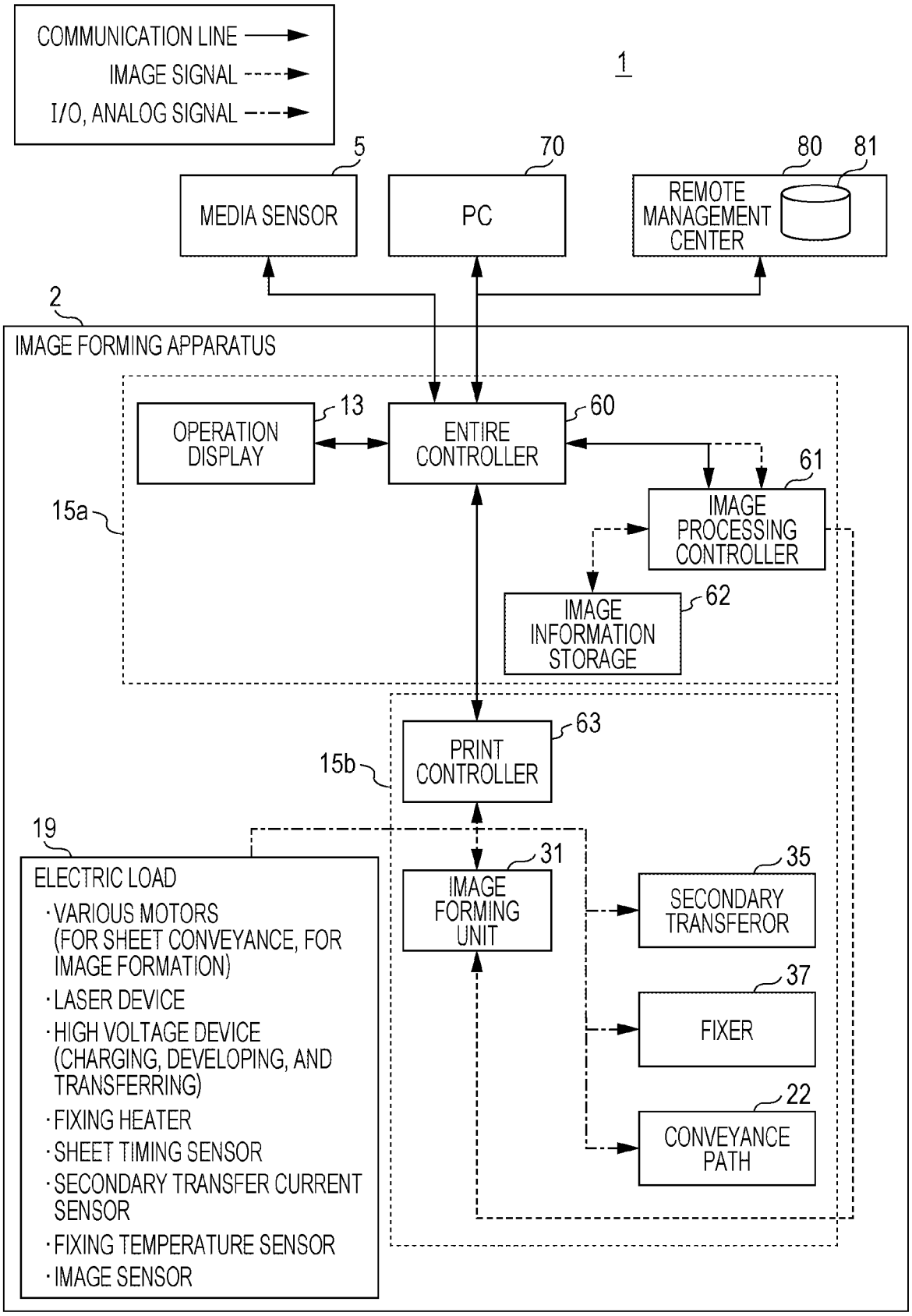
FIG. 3 is a block diagram showing an example of internal processing of an image forming apparatus according to an embodiment of the present invention.

FIG. 3 is a block diagram showing an example of internal processing of the image forming apparatus 2. A solid arrow in the figure represents a path for a communication line, a dashed arrow represents a path for an image signal, and a one dotted chain arrow represents a path for data input/output (I/O) or an analog signal.

To the image forming apparatus 2, the PC 70 is connected via the LAN, and a remote management center 80 is also connected via the Internet, for example. The image forming apparatus 2 starts a printing operation or the like in accordance with an instruction from the operation display 13, the PC 70, or the remote management center 80.

The image forming apparatus 2 includes the entire controller 60, an image processing controller 61, an image information storage 62, and a print controller 63, in addition to the functional units described with reference to FIG. 1. Then, the control board 15 shown in FIG. 2 is divided into control boards 15*a* and 15*b* according to main functions. Each function of the operation display 13, the entire controller 60, the image processing controller 61, and the image information storage 62 is realized by the control board 15*a* related to image processing. Further, each function of the print controller 63, the image former 30, the secondary transferor 35, the fixer 37, and the conveyance path 22 is realized by the control board 15*b* related to image formation on the sheet Sh.

Upon receiving the instruction from the operation display 13, the PC 70, or the remote management center 80, the entire controller 60 used as an example of a controller outputs a bitmap-developed image signal to the image processing controller 61. The image processing controller 61 performs predetermined image processing on the image signal inputted from the entire controller 60, and stores image information after image processing, in the image information storage 62. Then, the image processing controller 61 outputs the image signal of the image information read from the image information storage 62, to the image forming unit 31 at a timing of printing execution.

Here, the entire controller 60 extracts one or more type candidates of the sheet Sh on the basis of the sheet information detected by the first detector 51. Then, the entire controller 60 executes test printing under image forming conditions set in accordance with the type candidates of the sheet Sh extracted based on the sheet information, and specifies one sheet type from the sheet type candidates on the basis of an execution result of the test printing. In this test printing, for example, in addition to a process of forming an image on the sheet Sh by the image former 30, there are performed a process of energizing a secondary transfer current with the secondary transferor 35, a process of conveying the sheet Sh through the conveyance path 22, and a process of reading the sheet Sh by the image inspection device 4.

For example, after confirming the execution result of the test printing performed on the sheet Sh, the user can input one type of sheet Sh from the operation display 13, to allow the entire controller 60 to specify the type of the sheet Sh.

Further, the entire controller 60 can automatically specify one type of the sheet Sh from a plurality of type candidates of the sheet Sh. Therefore, the first detector 51 detects the sheet information on the sheet Sh without depending on the printing conditions. That is, the first detector 51 detects the sheet information before the printing conditions are determined by the entire controller 60.

After that, the entire controller 60 determines the printing conditions in accordance with the sheet type candidates extracted on the basis of the sheet information detected by the first detector 51. Therefore, the second detector detects information regarding the sheet Sh in accordance with the printing conditions determined by the entire controller 60. Then, the entire controller 60 can specify one type of the sheet Sh from type candidates of the sheet Sh, on the basis of the printing conditions and the information regarding the sheet Sh detected by the second detector. In this way, by setting two steps of a coarse detection method of sheet information with use of the first detector 51 and a detailed detection method of information regarding the sheet Sh with use of the second detector, the entire controller 60 can accurately narrow down one sheet type from a plurality of sheet type candidates. The sheet type according to the present embodiment is, for example, a sheet number or the like that uniquely specifies a type of the sheet Sh.

Therefore, the entire controller 60 outputs a print instruction to the print controller 63 for each print. In accordance with the inputted print instruction, the print controller 63 controls the loads of the image former 30, the secondary transferor 35, the fixer 37, the conveyance path 22, and the like to cause the conveyance path 22 to convey the sheet Sh, and to cause the image former 30, the secondary transferor 35, and the fixer 37 to perform a print operation including an image forming process on the sheet Sh.

At this time, if the printing condition is unsuitable, there is a possibility of a trouble that the sheet Sh is jammed or the sheet Sh adheres to a fixing roller. Therefore, the entire controller 60 causes the conveyance path 22 or the image former 30 to perform test printing with printing conditions that do not include a condition that is unsuitable in forming an image on the sheet Sh, for each of the plurality of type candidates of the sheet Sh. Examples of the condition that is unsuitable in forming an image on the sheet Sh include a fixing temperature that is less than a lower limit or an upper limit or more of a range defined by a fixing temperature limit value, for example, under the allowable control conditions shown in FIG. 7, which will be described later. By the entire controller 60 setting the printing conditions that do not include unsuitable conditions in this way, it is possible to inhibit troubles in the image forming apparatus 2 when determining one sheet type from a plurality of sheet type candidates.

The remote management center 80 manages a remaining amount of toner and an operation status of the image forming apparatus 2 to be managed, sheet information on the sheet Sh used in the image forming apparatus 2, and the like. Further, in addition to giving print instructions to the image forming apparatus 2 as described above, the remote management center 80 acquires optimum printing conditions according to the sheet information from the image forming apparatus 2, and manages optimum printing conditions. For this purpose, the remote management center 80 includes a management database 81.

When the media sensor 5 installed in another image forming apparatus 2 detects sheet information on the sheet Sh, the remote management center 80 acquires this sheet information from the image forming apparatus 2, and saves the sheet information in the management database 81. On the basis of a relationship between the sheet information saved in the management database 81 and the printing conditions, the remote management center 80 may notify the another image forming apparatus 2 of printing conditions according to the sheet information detected by the media sensor 5 of the another image forming apparatus 2. This notification allows the another image forming apparatus 2 to perform the image forming operation under the optimum printing conditions according to the sheet information.

Installation Location of Media Sensor

Figure 4:
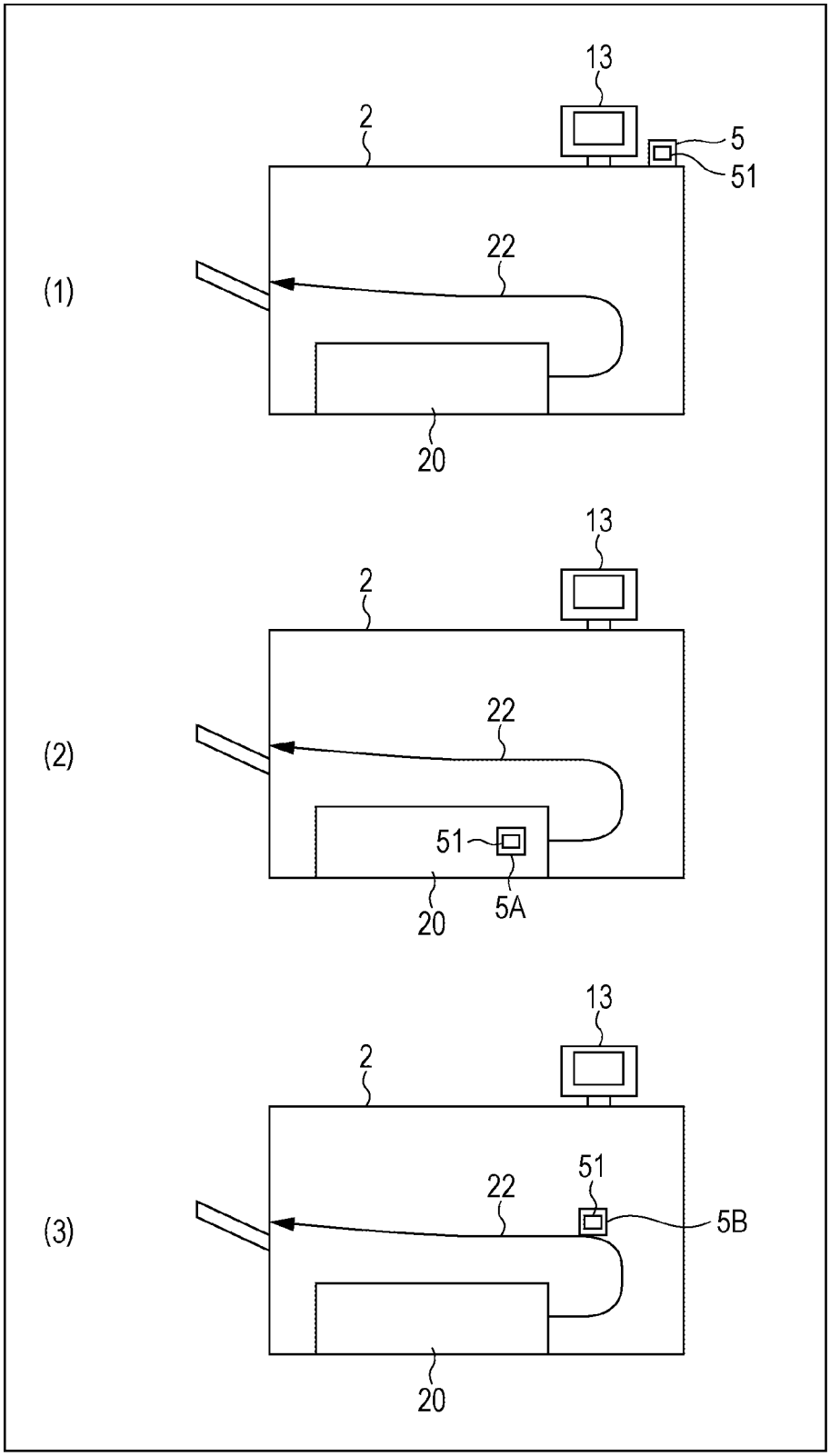
FIG. 4 is a view showing an example of an installation location of a media sensor according to an embodiment of the present invention.

FIG. 4 is a view showing an example of an installation location of the media sensor. The following examples (1) to (3) are assumed as the installation location of the media sensor. Note that, in FIG. 4, the description of the image inspection device 4 is omitted.

Installation location (1) represents an example in which the media sensor 5 is installed outside the image forming apparatus 2 as shown in FIG. 1. The first detector 51 is included in the media sensor 5 provided outside the image forming apparatus 2. As described above, the image forming apparatus 2 has the conveyance path 22, the image former 30 (see FIG. 1), the entire controller 60 (see FIG. 3), and the second detector.

The user manually sets the sheet Sh in the media sensor 5 installed outside the image forming apparatus 2, and causes the media sensor 5 to detect sheet information on the sheet Sh. In a case of the configuration shown in Installation location (1), one media sensor 5 is sufficient, which can reduce a construction cost of the image forming system 1.

Installation location (2) is an example in which a media sensor 5A is installed inside the image forming apparatus 2. A first detector 51 included in the media sensor 5A is provided to a path where the sheet Sh is supplied from the sheet feeding tray 20 to the conveyance path 22. That is, the media sensor 5A is provided for each sheet feeding tray 20.

When the sheet Sh is stored in the sheet feeding tray 20, the media sensor 5A automatically detects sheet information on the sheet Sh. That is, the media sensor 5A can detect the sheet information without the user performing work of causing the media sensor 5A to detect the sheet Sh. After that, the entire controller 60 changes the printing conditions on the basis of the sheet information detected by the media sensor 5A, and specifies a sheet type of the sheet Sh. In Installation location (2), since the media sensor 5A is provided in each sheet feeding tray 20, it is not necessary for the user to perform work of causing each media sensor to detect the sheet information on the sheet Sh, which improves convenience of the user.

Installation location (3) is also an example in which a media sensor 5B is installed inside the image forming apparatus 2. A first detector 51 included in the media sensor 5B is provided to the conveyance path 22 on upstream of the image former 30. Then, the media sensor 5B automatically detects sheet information on the sheet Sh in a middle of being fed from the sheet feeding tray 20 and being conveyed in the conveyance path 22.

In a case of Installation location (3), even in the image forming apparatus 2 provided with a plurality of sheet feeding trays 20, a construction cost of the image forming system 1 can be reduced since one media sensor 5B alone needs to be used. Further, as will be described later, for the sheet Sh conveyed by the conveyance path 22 under a plurality of test printing conditions set in the test printing, the entire controller 60 can specify the sheet type on the basis of a result obtained by the media sensor 5B detecting the sheet information for each test printing condition.

As the second detector, instead of using the special sensor that specifies the sheet type of the sheet Sh according to the present embodiment, an existing sensor for another purpose may be used. Further, in the cases of Installation locations (2) and (3), the second detector is provided to the conveyance path 22. This can reduce a construction cost for providing the second detector in the image forming system 1.

Problem of Conventional Test Printing

Here, a description will be given to a problem of test printing that has been conventionally performed for specifying the sheet type of the sheet Sh.

The media sensor 5 can determine the sheet type of the sheet Sh in a state where the sheet Sh stands still. However, if accuracy of the media sensor 5 to detect the sheet type is low, it has been difficult to narrow down the sheet type to one.

For example, depending on the sheet type, time from starting conveyance of the sheet Sh from the sheet feeding tray 20 to reaching a predetermined position in the image forming apparatus 2 differs. Therefore, it is necessary to pass the sheet Sh through the image forming apparatus 2 to measure the time. Moreover, since a transfer current value varies depending on the sheet type, it is necessary to transfer an image to the sheet Sh to measure the transfer current value. Further, since gradation of an image printed on the sheet Sh differs depending on the sheet type of the sheet Sh, it is necessary to print a test patch to measure the gradation of the image with the readers 45*a* and 45*b*.

Therefore, it is considered possible to improve the accuracy for detecting the sheet type by additionally detecting characteristics of the sheet Sh with various sensors in the image forming apparatus 2 and the image inspection device 4. In this case, it is necessary to actually pass the sheet Sh through the image forming apparatus 2 to perform the image forming operation.

Meanwhile, before the media sensor 5 detects the sheet type of the sheet Sh, it is difficult for the image forming apparatus 2 to perform test printing because the sheet type has not been specified. In addition, when there is no prediction of the sheet type, that is, when the media sensor 5 (first detector 51) has not detected the sheet type of the sheet Sh, for example, test printing has been difficult as shown in the following reasons (1) and (2).

(1) If an appropriate air volume of air blown to feed the sheet Sh is unknown, jamming of the sheet Sh will occur. In order to avoid jamming of the sheet Sh, sheet feeding time needs to be significantly reduced.

(2) If an appropriate fixing temperature is unknown, the sheet Sh may be wound around a roller of the fixer 37. However, if the fixing temperature is lowered to avoid winding of the sheet Sh, toner does not melt, which disables printing of the test image on the sheet Sh.

Therefore, in order to solve these problems, the entire controller 60 extracts one or more sheet type candidates from sheet types detected by the media sensor 5, and changes printing conditions such as a control value and a control target at the time of test printing, in accordance with the sheet type candidates. Then, the entire controller 60 specifies one sheet type from the plurality of sheet type candidates, on the basis of a result of the test printing including a detection result by the second detector. After that, the entire controller 60 executes, as actual printing, printing for a job inputted by the user, under the printing conditions according to the specified sheet type.

Hereinafter, processing required to specify the sheet type according to the present embodiment will be described. The test printing according to the present embodiment is not limited to an operation of forming a test image on the sheet Sh, but also includes an operation of causing the conveyance path 22 to convey the sheet Sh without forming the test image on the sheet Sh.

Display Example of Operation Screen

Next, an operation screen displayed on the operation display 13 will be described.

Figure 5:
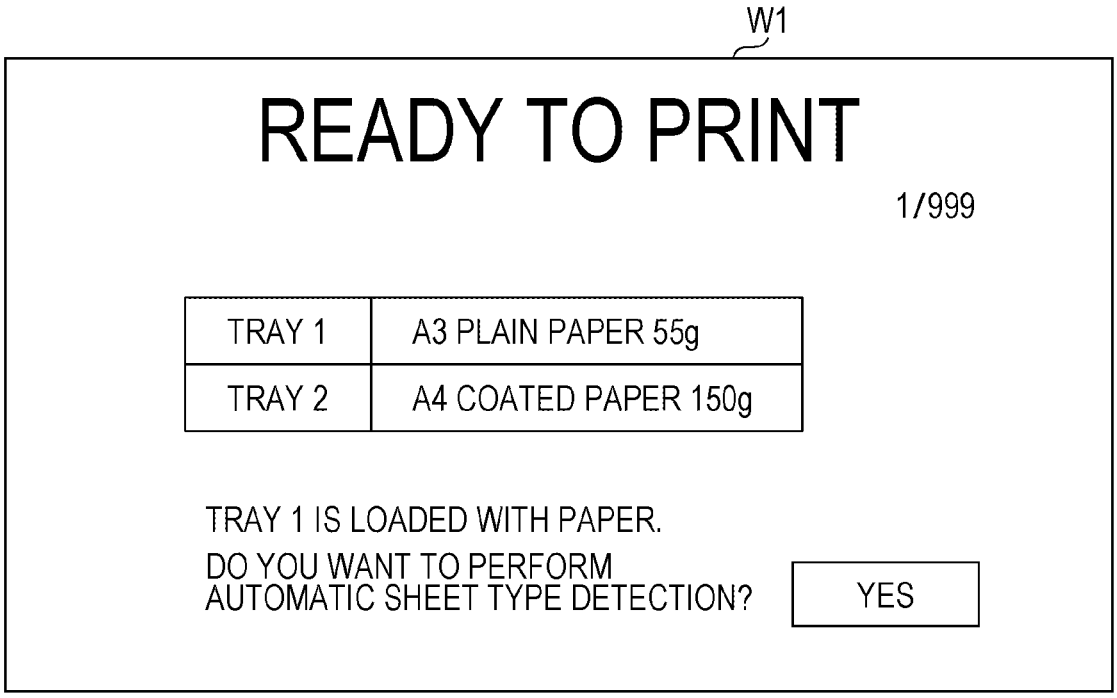
FIG. 5 is a view showing a display example of an operation screen according to an embodiment of the present invention.

FIG. 5 is a view showing a display example of an operation screen W1.

For example, when Sheet feeding tray 1 is opened, the sheet Sh is loaded, and then Sheet feeding tray 1 is closed, the operation screen W1 shown in FIG. 5 is displayed on the operation display 13. For example, it is assumed this time that, before the user opens and closes Sheet feeding tray 1, sheet information in which a sheet size is A3, a sheet type is plain paper, and a basis weight is 55 g has already been set in Sheet feeding tray 1. Further, it is assumed that, in Sheet feeding tray 2, sheet information in which a sheet size is A4, a sheet type is coated paper, and a basis weight is 150 g has already been set.

However, if Sheet feeding tray 1 is opened and closed in this process, the entire controller 60 is no longer able to know whether the sheet type of the sheet Sh loaded in Sheet feeding tray 1 is the same as or different from the sheet type of the sheet Sh loaded in Sheet feeding tray 1 up to the previous time. Then, if the sheet type of the sheet Sh set by the user in Sheet feeding tray 1 this time is different from the sheet type of the sheet Sh set in Sheet feeding tray 1 up to the previous time, printing defects will occur unless a new sheet type is set for Sheet feeding tray 1.

Therefore, on the operation screen W1, a message "Tray 1 is loaded with paper. Do you want to perform automatic sheet type detection?" is displayed. For example, the user can confirm the sheet information set in Sheet feeding tray 1 displayed on the operation screen W1, and press a print button (not shown) provided on the operation display 13 to instruct a start of printing when the sheet information is correct. Whereas, when correct sheet information needs to be set again to Sheet feeding tray 1 because the sheet information is incorrect, the user presses a YES button displayed on the operation screen W1.

This operation allows the user to input an execution instruction of the automatic sheet type detection. When the execution instruction of the automatic sheet type detection is inputted, a process of specifying the sheet type by the entire controller 60 described in FIG. 6 and later is started. As a result, the sheet type of the sheet Sh loaded in Sheet feeding tray 1 is specified, and correct sheet information is set in Sheet feeding tray 1.

For example, in the example shown in Explanatory view (1) of FIG. 4 in which the media sensor 5 including the first detector 51 is provided outside the image forming apparatus 2, as the sheet Sh is set at the media sensor 5, the entire controller 60 extracts one or more sheet type candidates on the basis of sheet information detected by the first detector 51. Therefore, the extracted sheet type candidates may be displayed on the operation screen W1 shown in FIG. 5, and the sheet type of the sheet Sh loaded in the sheet feeding tray may be specified when the user selects a sheet type from the sheet type candidates. Further, by the user pressing the YES button in the operation screen W1 even without selecting the sheet type from the operation screen W1, the sheet Sh may be conveyed in the image forming apparatus 2, the second detector may detect information regarding the sheet Sh, and the entire controller 60 may specify the sheet type of the sheet Sh.

Further, in the configuration shown in Explanatory view (2) of FIG. 4 in which the media sensor 5A including the first detector 51 is provided to the sheet feeding tray, the first detector 51 of the media sensor 5A detects sheet information, and the entire controller 60 extracts one or more sheet type candidates, for example, at a timing when the sheet feeding tray loaded with the sheet Sh is closed. At this time, the extracted sheet type candidates may be displayed on the operation screen W1, and the sheet type of the sheet Sh loaded in the sheet feeding tray may be specified when the user selects a sheet type from the sheet type candidates. Whereas, by the user pressing the YES button in the operation screen W1 even when the extracted sheet type candidates are not displayed on the operation screen W1, the sheet Sh may be conveyed in the image forming apparatus 2 again, the second detector may detect information regarding the sheet Sh, and the entire controller 60 may specify the sheet type of the sheet Sh.

Further, also in the configuration shown in Explanatory view (3) of FIG. 4 in which the media sensor 5B including the first detector 51 is provided to the sheet feeding tray, for example, the sheet Sh is conveyed in the image forming apparatus 2 at a timing when the sheet feeding tray loaded with the sheet Sh is closed, the first detector 51 of the media sensor 5B provided to the conveyance path 22 detects sheet information, and the entire controller 60 extracts one or more sheet type candidates. At this time, the extracted sheet type candidates may be displayed on the operation screen W1, and the sheet type of the sheet Sh loaded in the sheet feeding tray may be specified when the user selects a sheet type from the sheet type candidates. Whereas, by the user pressing the YES button in the operation screen W1 even when the extracted sheet type candidates are not displayed on the operation screen W1, the sheet Sh may be conveyed in the image forming apparatus 2 again, the second detector may detect information regarding the sheet Sh, and the entire controller 60 may specify the sheet type of the sheet Sh.

Next, processing performed by the image forming system 1 will be described.

Figure 6:
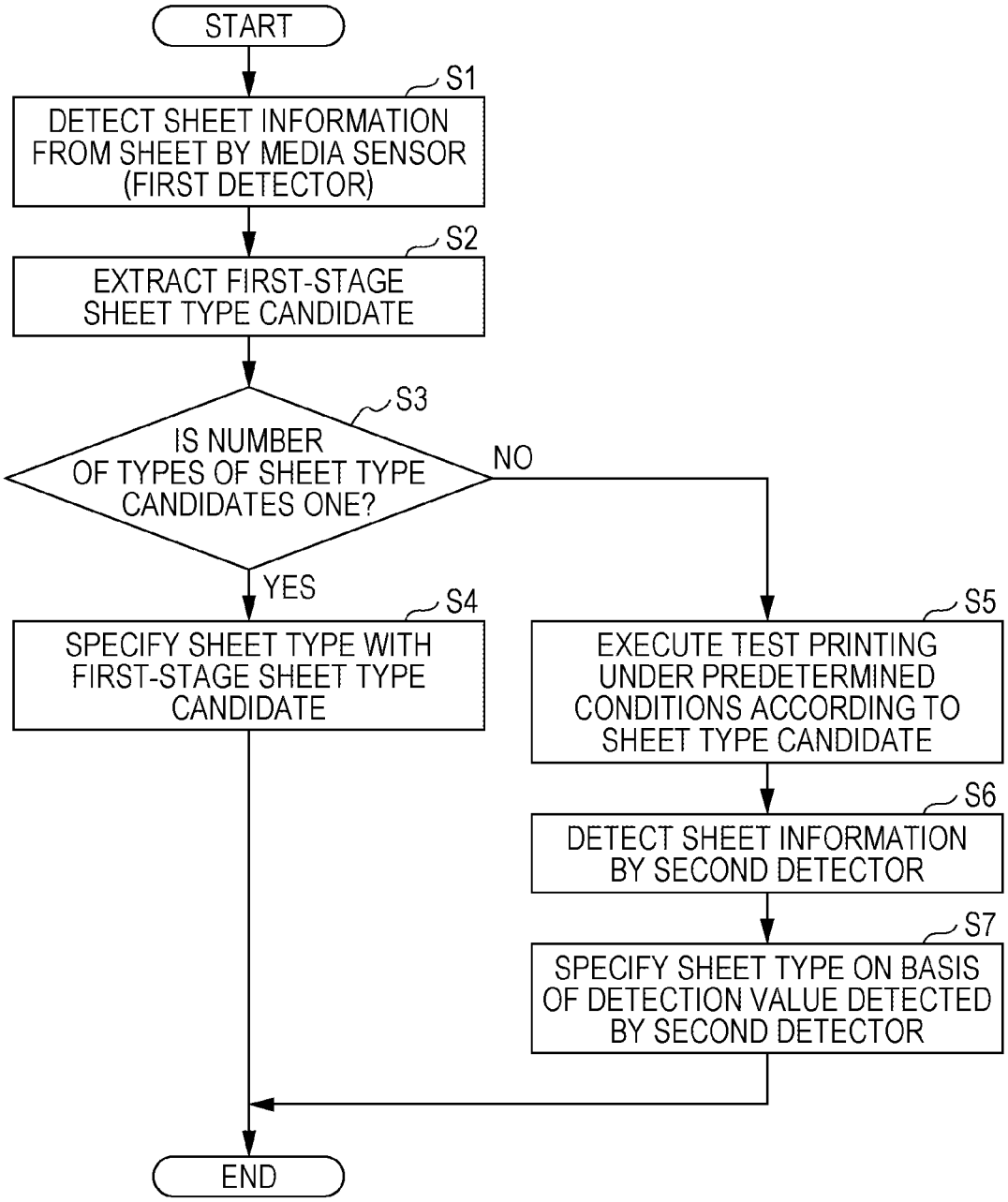
FIG. 6 is a flowchart showing an example of a process of specifying a sheet type by an entire controller according to an embodiment of the present invention.

FIG. 6 is a flowchart showing an example of a process of specifying a sheet type by the entire controller 60.

First, the user sets the sheet Sh at the media sensor 5 installed outside the image forming apparatus 2 (offline), and instructs the media sensor 5, through the operation display 13, to detect sheet information (a paper thickness, a basis weight, smoothness, and the like) of the sheet Sh (S1). The media sensor 5 detects the sheet information on the set sheet Sh and outputs the sheet information on the sheet Sh to the entire controller 60.

Note that, in the configuration shown in the Explanatory views (2) and (3) of FIG. 4 in which the media sensors 5A and 5B are provided inside the image forming apparatus 2, the process of step S1 is replaced with a process of detecting sheet information by the media sensors 5A and 5B in a process of feeding one sheet of the sheets Sh from the sheet feeding tray to the conveyance path 22.

Next, the entire controller 60 reads out and executes a known sheet-type determination program built in the ROM 17, and extracts a first-stage sheet type candidate of the sheet Sh (S2), on the basis of the sheet information outputted by the media sensor 5. As the first-stage sheet type candidate, one or more sheet type candidates are extracted. Next, the entire controller 60 determines whether or not the number of types of the first-stage sheet type candidates is one (S3).

When the number of types of the first-stage sheet type candidates is one (YES in S3), the user or the entire controller 60 specifies this sheet type candidate as the sheet type of the sheet Sh (S4). Then, the entire controller 60 updates sheet type registration information registered in the RAM 18 with the determined sheet type, and ends this process. At this time, when the user uses the operation display 13 to specify the sheet feeding tray 20 that stores the sheet Sh whose sheet type candidate has been specified, the sheet type registration information is updated. The sheet type registration information can also be updated automatically by the entire controller 60.

Whereas, when the number of types of the first-stage sheet type candidates is not one, that is, there are plurality of types (NO in S3), the user loads the sheet Sh in the sheet feeding tray 20 and instructs the operation display 13 to narrow down the sheet type. This instruction is given, for example, by the user pressing the YES button on the operation screen W1 shown in FIG. 5.

When narrowing down of the sheet type is instructed, the entire controller 60 executes test printing under predetermined conditions according to the sheet type candidates (S5). Here, the entire controller 60 may cause the conveyance path 22 or the image former 30 to perform test printing under a single condition within a range defined by the printing conditions, to narrow down one sheet type from the sheet type candidates in a short time. Further, the entire controller 60 may also cause the conveyance path 22 or the image former 30 to perform test printing under a plurality of conditions within a range defined by the printing conditions, to narrow down one sheet type from a plurality of sheet type candidates having similar paper qualities. The printing conditions include at least one condition of a sheet feeding air volume, a transfer condition, a fixing condition, or a test image, whose control value is changed in accordance with the sheet type candidate. However, the printing conditions are not to include conditions that are unsuitable in forming an image on the sheet Sh.

Then, in the test printing executed in step S5, the entire controller 60 changes at least one operation of the electric load 19, the image former 30, or the conveyance path 22, in accordance with the conditions within the range defined by the printing conditions. For example, the entire controller 60 varies a fixing temperature, increases or decreases a secondary transfer current, and varies a conveyance speed of the sheet Sh.

Then, the second detector detects the sheet Sh to be test-printed (S6). A detection value of the sheet Sh detected by the second detector is outputted to the entire controller 60.

The entire controller 60 specifies the sheet type of the sheet Sh to one sheet type from a plurality of sheet type candidates, on the basis of the detection value inputted from the second detector during the test printing (S7). Then, the entire controller 60 updates the sheet type registration information set for the sheet feeding tray 20 that has stored the test-printed sheet Sh, causes the RAM 18 to store the sheet type registration information, and ends this process.

Method for Determining Test Printing Conditions

Next, a method for determining test printing conditions that do not include NG conditions for each of the plurality of sheet type candidates will be described with reference to FIG. 7.

FIG. 7 is a view showing a configuration example of an allowable control condition table.

In the allowable control condition table, a basis weight of the sheet Sh and allowable control conditions are stored in the ROM 17, for each sheet type of the sheet Sh used in the image forming apparatus 2. This allowable control condition table is provided for each of the paper quality of the sheet Sh, for example, for each of plain paper and coated paper. For example, when the table shown in FIG. 7 is provided for plain paper, a similar table is also provided for coated paper.

Examples of the allowable control conditions shown in FIG. 7 include, for example, a fixing temperature target value (° C.) and a fixing temperature limit value (° C.) when the fixer 37 fixes an image on the sheet Sh, and a secondary transfer current target value (mA) and a secondary transfer current limit value (mA) when the secondary transferor 35 secondarily transfers an image onto the sheet Sh. In addition to this, as allowable control conditions, for example, there are a sheet feeding air volume of air that is blown onto the sheet Sh to float a tip end of the sheet Sh when the sheet Sh is fed from the sheet feeding tray 20, a sheet conveyance speed when the conveyance path 22 conveys the sheet Sh, and the like.

The fixing temperature, the secondary transfer current, the sheet feeding air volume, and the sheet conveyance speed that can be detected by the secondary detector are called factors. Exceeding of an allowable range indicated by a limit value for each factor causes jamming of the sheet Sh or defects in an image formed and fixed on the sheet Sh. Therefore, the entire controller 60 changes the printing conditions at the time of test printing so as not to exceed a lower limit value or an upper limit value of the allowable range set for each factor detected by the secondary detector.

It is assumed that, as a result of the media sensor 5 reading the sheet Sh, three sheet types of: Sheet type a with a basis weight in a range of 150 to 199 g; Sheet type b with a basis weight in a range of 200 to 249 g; and Sheet type c with a basis weight in a range of 250 to 299 g shown in the allowable control condition table shown in FIG. 7 are selected as sheet type candidates. From the allowable control condition table, it can be seen that a fixing temperature limit value of Sheet type a is 160 to 170° C., a fixing temperature limit value of Sheet type b is 160 to 175° C., and a fixing temperature limit value of Sheet type c is 170 to 185° C.

Here, temperatures (190° C., and the like) exceeding the fixing temperature limit value in Sheet types a, b, and c are fixing temperatures that are not appropriate for test printing, and are unsuitable for test printing. A printing condition including a value exceeding a limit value, which is unsuitable in forming an image on the sheet Sh in this way, is called an "NG condition". Whereas, even if a plurality of sheet type candidates are selected, as long as there is a fixing temperature allowable for any of the sheet type candidates, the entire controller 60 uses the fixing temperature in the test printing. For example, the entire controller 60 sets the fixing temperature within the fixing temperature limit values of Sheet types a, b, and c to 170° C. (circled in the figure), and performs test printing to specify a one sheet type from a plurality of sheet type candidates.

FIG. 8 is a view showing an example of paper quality, a basis weight, and a size for each sheet type candidate.

For each of three types (Sheet types A, B, and C) of sheet type candidates, paper quality, a basis weight, and a size can be determined by known techniques. Here, Sheet types a, b, and c selected in the allowable control condition table shown in FIG. 7 are different from Sheet types A, B, and C described in FIG. 8 and later.

The paper quality of Sheet type candidate A shown in FIG. 8 is plain paper, while the paper quality of Sheet type candidates B and C is coated paper. Basis weights of Sheet type candidates A and B are within a range of 50 to 99 g, while a basis weight of Sheet type candidate C is within a range of 100 to 149 g. Further, sizes of Sheet type candidates A, B, and C are all the same A3. Although not shown in FIG. 8, it is assumed that paper thicknesses of Sheet type candidates A, B, and C are all the same.

In this way, Sheet type candidates A, B, and C are different in paper quality and basis weight. Therefore, the following two types of test printing are performed twice.

(1) First Test Printing

A difference in paper quality of the sheet Sh tends to appear as a difference in image quality. Therefore, in the first test printing, the entire controller 60 instructs the image former 30 to print a test image. Then, the entire controller 60 discriminates between Sheet type candidate A and Sheet type candidates B and C on the basis of a result of the readers 45*a* and 45*b* reading the test image printed on the sheet Sh.

(2) Second Test Printing

A difference in basis weight of the sheet Sh tends to appear as a difference in a behavior of the sheet Sh. Therefore, in the second test printing, the entire controller 60 passes the sheet in a state where a sheet feeding air volume of air to be fed to the sheet Sh during sheet feeding is fixed. Then, the entire controller 60 discriminates between Sheet type candidates A and B and Sheet type candidate C, on the basis of a behavior of the sheet Sh, that is, a sheet arrival time measured by the timing sensor 21.

If the number of types of sheet type candidates extracted by the entire controller 60 from the detection result of the first detector 51 is one or two, the sheet type can be specified with one test printing alone. In FIG. 8, an example of performing two types of test printing has been described. However, even if the number of types of the sheet type candidates is three, the entire controller 60 may simultaneously cause reading of the test-printed test image and measuring of the sheet arrival time of the sheet Sh that has been passed through with the fixed sheet feeding air volume, to specify the sheet type with one test printing alone.

In this way, the entire controller 60 determines a condition for changing a control value in accordance with a difference for each factor (paper quality, a basis weight, a size, and the like) in a plurality of type candidates of the sheet Sh. By determining control conditions in accordance with factors that tend to differ for each sheet type and performing test printing, the entire controller 60 can accurately narrow down one sheet type from a plurality of sheet type candidates.

As shown in FIG. 8, when the entire controller 60 can classify sheet type candidates on the basis of the paper quality or the basis weight, it is possible to select the second detector to be used during test printing, and specify the sheet type from a plurality of sheet type candidates on the basis of a value detected by the second detector. Therefore, a description is given to an example of a sensor detection value table representing a detection value of each sensor, which is used as the second detector for each characteristic of the sheet Sh.

Figure 9:
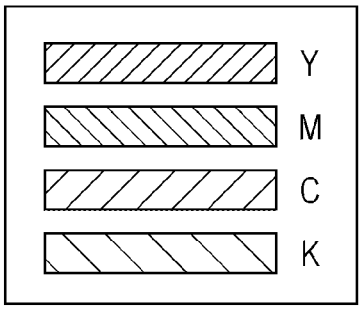
FIG. 9 is an explanatory view showing an example of a sensor detection value table according to an embodiment of the present invention.

FIG. 9 is an explanatory view showing an example of the sensor detection value table. Each sensor detection value table shown in the following Explanatory views (1) to (3) is stored in the ROM 17. Further, Explanatory view (4) is an example of a test image that has been test-printed on the sheet Sh.

Explanatory view (1) of FIG. 9 shows an example of the sensor detection value table showing a relationship between paper quality and an image density. Image densities that differ depending on the paper quality are detected by the readers 45*a* and 45*b* used as the second detector. The image density shown in the figure represents a maximum density of a test image that has been test-printed on the sheet Sh. Explanatory view (1) shows that the image density differs depending on a difference in paper quality of the sheet Sh. For example, the image density is "8" when the paper quality of the sheet Sh is plain paper, and the image density is "9" to "10" when the paper quality of the sheet Sh is coated paper. Then, the entire controller 60 refers to the sensor detection value table in Explanatory view (1) and obtains paper quality corresponding to the image density.

Explanatory view (2) of FIG. 9 shows an example of the sensor detection value table showing a relationship between a basis weight and a sheet arrival time. The timing sensor 21 used as the second detector detects a sheet arrival time, which differs depending on a basis weight. As the basis weight is larger, the sheet arrival time becomes longer. Here, it is shown that the sheet arrival time differs depending on a difference in the basis weight of the sheet Sh. For example, the sheet arrival time is 150 to 154 ms when the basis weight is 50 to 99 g, the sheet arrival time is 155 to 159 ms when the basis weight is 100 to 149 g, and the sheet arrival time is 160 to 164 ms when the basis weight is 150 to 199 g.

Therefore, the entire controller 60 causes the conveyance path 22 to convey the sheet Sh under the printing conditions according to the type candidates of the sheet Sh, and acquires the time (sheet arrival time), which is detected by the second detector, until the sheet Sh reaches a predetermined position from the sheet feeding tray, as information regarding the sheet Sh. Then, the entire controller 60 refers to the sensor detection value table in Explanatory view (2) and obtains a basis weight corresponding to the sheet arrival time.

For example, in the example shown in FIG. 8, there has been a difference in the paper quality and the basis weight of the sheet Sh. Therefore, as a characteristic of the sheet Sh, the entire controller 60 detects the image density with the readers 45*a* and 45*b* described with reference to Explanatory view (1), and detects the sheet arrival time with the timing sensor 21 described with reference to Explanatory view (2).

Explanatory view (3) of FIG. 9 shows an example of the sensor detection value table showing a relationship between a paper thickness and a secondary transfer current. A value of the secondary transfer current, which differs depending on a paper thickness, is detected by the secondary transfer current sensor 36 that is used as the second detector. As the paper thickness is increased, a value of the secondary transfer current is increased. Here, it is shown that the secondary transfer current differs depending on a difference in paper thickness of the sheet Sh. For example, the secondary transfer current is less than 150 μA for the sheet Sh with the paper thickness of 100 μm or less, the secondary transfer current is 151 to 170 μA for the sheet Sh with the paper thickness of 101 to 250 μm, the secondary transfer current is 171 to 190 μA for the sheet Sh with the paper thickness of 211 to 500 μm, and the secondary transfer current is 191 μA or more for the sheet Sh with the paper thickness of 511 μm or more. Then, the entire controller 60 refers to the sensor detection value table in Explanatory view (3), and obtains a paper thickness corresponding to the secondary transfer current.

Explanatory view (4) of FIG. 9 is an example of a test image that has been test-printed on the sheet Sh. As the test image, a patch image in which the sheet Sh is solid-painted with each color of Y, M, C, and K is used. The entire controller 60 gives an instruction to the image former 30 to form the test image on the sheet Sh according to the type candidates of the sheet Sh, and the second detector outputs information regarding the sheet Sh formed with the test image, to the entire controller 60. Then, the entire controller 60 can specify one sheet type from the sheet type candidates of the sheet Sh on the basis of the information regarding the sheet Sh formed with the test image.

As a result of the test printing, when the secondary transfer current is 157 μA and the image density is "9", the entire controller 60 determines that the basis weight of the sheet Sh is 100 to 149 g and the paper quality is coated paper. Therefore, the entire controller 60 can specify the sheet type of the sheet Sh as Sheet type candidate C shown in FIG. 8.

Note that, when performing test printing, it is necessary to change the printing conditions in accordance with the purpose.

Therefore, the printing conditions for test printing will be described with reference to FIG. 10.

FIG. 10 is a view showing a correspondence between a predetermined condition and a purpose in test printing.

For example, if the entire controller 60 has not narrowed down the sheet types to one, various troubles may occur during test printing under the printing conditions of test printing set in accordance with the plurality of sheet type candidates. Examples of types of the trouble include jamming due to an improper sheet feeding air volume, and winding of the sheet Sh around a transfer roller due to an improper transfer condition. In addition, due to an improper fixing condition (control temperature), toner stains on the fixing roller and blister phenomenon (for example, swelling on an image forming surface) may occur, and the sheet Sh may be wound around the fixing roller. In addition, the sheet Sh may be wound around the fixing roller due to an improper test image.

For the purpose of avoiding such troubles, the entire controller 60 needs to set printing conditions suitable for the plurality of sheet type candidates. A relationship shown in FIG. 10 shows that, for example, it is necessary to select an appropriate fixing temperature within a limit range in accordance with the conditions shown in FIG. 7, when the purpose is to inhibit toner stains. In addition, it is shown that a proper sheet feeding air volume and a proper test image are required in order to inhibit jamming and winding of the sheet Sh around the fixing roller. However, in the allowable control condition table in FIG. 7, when a sheet type with a basis weight in the range of 50 to 99 g and a sheet type with a basis weight in the range of 250 to 299 g are extracted, the fixing temperature limit values do not overlap. In this case, if test printing is performed with the fixing temperature limit value of 170 to 185° C. in accordance with a sheet type candidate with a basis weight of 250 to 299 g in spite of the fact that the basis weight of the sheet Sh is actually 50 to 99 g and the limit value of the fixing temperature is 150 to 160° C., there is a possibility of significant damage on the sheet Sh.

Therefore, for example, when the fixing temperature does not fall within the limit range defined for each of the plurality of sheet type candidates, the entire controller 60 sets a different fixing temperature each time and performs the test printing for a plurality of times. Then, when the fixing temperature is changed as the fixing condition, the entire controller 60 changes the fixing temperature in an order from a low fixing temperature to a high fixing temperature. Further, the entire controller 60 does not have to perform test printing at a high fixing temperature as long as the sheet type of the sheet Sh can be specified at a low fixing temperature. By changing the fixing temperature in this way to perform test printing, it is possible to avoid a situation in which the sheet Sh is wound around the fixing roller to disable the subsequent test printing, due to test printing being performed at an inappropriately high fixing temperature.

In addition, even if the sheet feeding air volume does not fall within the limit range defined for each of the plurality of sheet type candidates, the entire controller 60 sets a different sheet feeding air volume each time (the first sheet feeding air volume is small, the second sheet feeding air volume is large), and performs test printing for a plurality of times. Similarly, for other purposes, test printing is performed for a plurality of times. For example, even if the secondary transfer current does not fall within the limit range defined for each of a plurality of sheet type candidates, by setting a different secondary transfer current each time (the first secondary transfer current is small, the second secondary transfer current is large), test printing is performed for a plurality of times.

In the image forming system 1 according to the embodiment described above, by detecting sheet information from the sheet Sh with the media sensor 5 used as the first sensor, the entire controller 60 extracts one or more sheet type candidates. Then, the entire controller 60 specifies a sheet type from the sheet type candidates, on the basis of an execution result of processing performed by changing the printing conditions in accordance with the extracted sheet type candidates.

Here, the second detector in which a characteristic difference of the sheet type appears remarkably differs depending on the sheet type candidate. Therefore, the entire controller 60 can accurately specify one sheet type from a plurality of Sheet type candidates by using a detection value of the sheet Sh detected by the second detector in test printing.

A plurality of types of the second detectors are provided in the image forming apparatus 2 or the image inspection device 4, and an existing sensor can be used as the second detector. Further, since the existing sensor is used as the second detector, it is not necessary to cause a new cost when configuring the image forming system 1 according to the present embodiment.

MODIFICATIONS

Test Printing Performed During Actual Printing

Up to this point, a description has been given to test printing for specifying one sheet type from a plurality of sheet type candidates, which is performed prior to actual printing. However, the test printing may be performed during the actual printing.

FIG. 11 is a view showing a relationship between a sheet type candidate, and allowable ranges of printing conditions and a maximum density (image quality characteristic value).

FIG. 11 shows a fixing temperature allowable range and a sheet feeding air volume allowable range as the allowable ranges of printing conditions. Further, FIG. 11 shows a maximum density of an image printed on the sheet Sh, as an image quality characteristic. A relationship between the sheet type candidates, and the allowable ranges of printing conditions and the image quality characteristics is stored in the ROM 17, and is appropriately read out when the entire controller 60 controls test printing.

Individual values of the fixing temperature allowable range and the sheet feeding air volume allowable range are different for each of Sheet type candidates D, E, and F. Depending on the sheet type, the density may be different or the same even if the printed image is the same. However, values of the maximum densities of Sheet type candidates D, E, and F are all within the same range of "7" to "8".

Here, there is a fixing temperature (for example, 170 to 175° C.) within all of the fixing temperature allowable ranges of Sheet type candidates D, E, and F, and there is a sheet feeding air volume (for example, 35 to 40%) within all of the sheet feeding air volume allowable ranges of Sheet type candidates D, E, and F. Therefore, in test printing, when the fixing temperature (for example, 170° C.) is within all of the fixing temperature allowable ranges, or the sheet feeding air volume (for example, 36%) is within all of the sheet feeding air volume allowable range, the user is less likely to notice a change in image quality.

When printing conditions and image quality of a plurality of sheet type candidates are similar in this way, it is possible to specify the sheet type during actual printing by performing test printing in parallel during the actual printing. If variations in an image quality characteristic value defined for each type of the sheet Sh among the plurality of type candidates of the sheet Sh is within a predetermined range, the entire controller 60 causes the conveyance path 22 or the image former 30 to perform the actual printing for a job inputted by the user, with one sheet Sh specified by the entire controller 60. As shown in FIG. 11, when the sheet type candidates fall within the limit allowable range of the printing conditions and the image quality characteristic values are the same, the actual printing and the test printing are performed in parallel. Then, the entire controller 60 specifies one type of the sheet Sh from the type candidates of the sheet Sh while causing the conveyance path 22 or the image former 30 to perform the actual printing.

Performing the test printing as well during the actual printing in this way can save the time required for the process for specifying the sheet type. Further, since the test-printed sheet Sh can be handled in the same manner as the actual printed sheet Sh, loss of the sheet Sh can be inhibited.

Other Modifications

Meanwhile, as the second detector, a gloss detection sensor that detects gloss of the sheet Sh or a paper thickness sensor that detects a thickness of the sheet Sh may be used.

FIGS. 8 and 11 have shown an example in which the sheet type is specified from characteristics of the sheet Sh by using a characteristic table in which characteristics are defined for each sheet type candidate. However, the entire controller 60 stores a detection result detected by the second detector during test printing or actual printing, into the RAM 18 in association with sheet information. Then, the entire controller 60 may specify the sheet information on the sheet Sh when a detection result detected by the second detector at the next test printing matches the detection result stored in the RAM 18.

Further, the test printing may include an operation of causing the conveyance path 22 to convey the sheet Sh without forming an image on the sheet Sh.

Moreover, an information processing apparatus outside the image forming apparatus 2 may extract one or more type candidates of the sheet Sh, from the sheet information detected by the first detector 51 of the media sensor 5. Then, the one or more type candidates of the sheet Sh extracted by the information processing apparatus may be outputted to the entire controller 60 and used in the subsequent processing.

In addition, when the entire controller 60 determines that a transfer current should be reduced in test printing by referring to a process adjustment value of sheet information, the entire controller 60 may select a sheet type associated with an adjustment value having a lowest transfer current, among the plurality of sheet type candidates.

In addition, the present invention is not limited to the above-described embodiment, and it is needless to say that various other application examples and modifications can be taken without departing from the gist of the present invention described in the claims.

For example, the above-described embodiment is detailed and concrete description of the configuration of the system for easy understanding of the present invention, and is not necessarily limited to that including all the described configurations. Moreover, a part of a configuration of the present embodiment may also be deleted, replaced, or added with another configuration.

Further, control lines and information lines indicate what is considered to be necessary for the description, and do not necessarily indicate all the control lines and the information lines on the product. In practice, it can be considered that almost all the structures are mutually connected.

Although embodiments of the present invention have been described and illustrated in detail, the disclosed embodiments are made for purposes of illustration and example only and not limitation. The scope of the present invention should be interpreted by terms of the appended claims.

What is claimed is:

1. An image forming system comprising an image forming apparatus including an image former that forms an image on a recording material, the image forming system comprising:

a first detector that detects recording material information on the recording material;

a recording material storage that stores the recording material; and a controller that specifies one type of the recording material from a plurality of type candidates of the recording material based on an execution result of test printing to generate a test image, by executing the test printing under an image forming condition that is set in accordance with the plurality of type candidates of the recording material, in the case that the plurality of type candidates are extracted based on the recording material information detected by the first detector.

2. The image forming system according to claim 1, further comprising:

a second detector that detects information regarding the recording material, in a process in which the image is formed on the recording material supplied from the recording material storage under the image forming condition and the recording material is discharged, wherein the controller specifies one type of the recording material from the plurality of type candidates of the recording material, based on the image forming condition and information regarding the recording material.

3. The image forming system according to claim 2, wherein the first detector detects the recording material independently of the image forming condition, and the second detector detects information regarding the recording material in accordance with the image forming condition.

4. The image forming system according to claim 2, further comprising:

a conveyor that conveys the recording material, wherein the controller causes the conveyor to convey the recording material under the image forming condition according to a type candidate of the recording material, and acquires, as information regarding the recording material, time until when the recording material reaches a predetermined position from the recording material storage, the time being detected by the second detector.

5. The image forming system according to claim 4, wherein the controller causes the conveyor or the image former to perform the test printing, in accordance with an image forming condition that does not include a condition unsuitable in forming the image on the recording material, for each of the plurality of type candidates of the recording material.

6. The image forming system according to claim 5, wherein the image forming condition includes at least one condition of a sheet feeding air volume, a transfer condition, a fixing condition, or the test image, whose control value is changed in accordance with a type candidate of the recording material.

7. The image forming system according to claim 6, wherein the controller determines the at least one condition in accordance with a difference for each of a plurality of factors in the plurality of type candidates of the recording material, the plurality of factors comprising paper quality, basis weight, and size.

8. The image forming system according to claim 6, wherein the controller causes the conveyor or the image former to perform the test printing under a single condition within a range defined by the image forming condition.

9. The image forming system according to claim 6, wherein the controller causes the conveyor or the image former to perform the test printing under a plurality of conditions within a range defined by the image forming condition.

10. The image forming system according to claim 6, wherein the controller instructs the image former to form, on the recording material, the test image according to a type candidate of the recording material, the second detector outputs information regarding the recording material formed with the test image, and the controller specifies one type of the recording material from the plurality of type candidates of the recording material, based on information regarding the recording material formed with the test image.

11. The image forming system according to claim 4, wherein the image forming apparatus includes the conveyor, the image former, the controller, and the second detector, and the first detector is included in a sheet information detection device provided outside the image forming apparatus.

12. The image forming system according to claim 4, wherein the first detector is provided to a path where the recording material is supplied from the recording material storage to the conveyor, and the image forming apparatus includes the first detector, the recording material storage, the conveyor, the image former, the controller, and the second detector.

13. The image forming system according to claim 4, wherein the image forming apparatus includes the first detector, the recording material storage, the conveyor, the image former, the controller, and the second detector, and the first detector is provided to the conveyor on upstream of the image former.

14. The image forming system according to claim 4, wherein the second detector is provided to the conveyor.

15. The image forming system according to claim 4, wherein in a subsequent stage of the image forming apparatus, an inspection device that performs a predetermined inspection on the recording material formed with the image is provided, or a post-processing device that performs post-processing on the recording material formed with the image is provided, and the controller determines information regarding the recording material detected by the second detector included in the inspection device or the post-processing device.

16. The image forming system according to claim 4, wherein the controller specifies one type of the recording material from the plurality of type candidates of the recording material, while causing the conveyor or the image former to perform actual printing.

17. The image forming system according to claim 4, wherein when a variation in an image quality characteristic value defined for each type of the recording material among the plurality of type candidates of the recording material is within a predetermined range, the controller causes the conveyor or the image former to perform actual printing for a job inputted by a user, with the recording material of one type specified by the controller.

18. The image forming system according to claim 1, wherein the controller executes actual printing for a job inputted by a user, in accordance with an image forming condition corresponding to a specified type of a recording material.

19. The image forming system according to claim 1, wherein the test printing includes an operation of causing a conveyor to convey the recording material, without forming the image on the recording material.

20. An image forming apparatus comprising:

an image former that forms an image on a recording material;

a recording material storage that stores the recording material; and a controller that specifies one type of the recording material from a plurality of type candidates of the recording material based on an execution result of test printing to generate a test image, by executing the test printing under an image forming condition that is set in accordance with the plurality of type candidates of the recording material, the plurality of type candidates being extracted based on recording material information detected by a first detector that detects the recording material information on the recording material.

21. A non-transitory recording medium storing a computer readable program executed by a computer of an image forming apparatus including an image former that forms an image on a recording material, the program causing the computer to execute:

inputting recording material information from a first detector that detects the recording material information on the recording material, and specifying one type of the recording material from a plurality of type candidates of the recording material based on an execution result of test printing to generate a test image, by executing the test printing under an image forming condition that is set in accordance with the plurality of type candidates of the recording material, the plurality of type candidates being extracted based on recording material information detected by the first detector that detects the recording material information on the recording material.

* * * * *